US005211569A

United States Patent [19]

Havens

[11] Patent Number: 5,211,569

[45] Date of Patent: May 18, 1993

[54] ELECTRICAL POWER CORD AND APPLIANCE USING SAME

[75] Inventor: Jeffrey L. Havens, Farmington Hills, Mich.

[73] Assignee: Petrina Havens

[21] Appl. No.: 800,142

[22] Filed: Nov. 27, 1991

[51] Int. Cl.[5] ..... H01R 13/00

[52] U.S. Cl. ..... 439/159

[58] Field of Search ..... 439/152, 153, 155-160, 439/38

[56] References Cited

U.S. PATENT DOCUMENTS

| | | | |
|---|---|---|---|
| 2,076,136 | 4/1937 | Weed | 439/38 |
| 2,955,273 | 10/1960 | Winkler | 339/45 |
| 3,118,713 | 1/1964 | Ellis | 439/38 |
| 3,431,428 | 3/1969 | Van Valer | 307/10 |
| 4,010,995 | 3/1977 | Britschgi et al. | 339/45 |
| 4,157,855 | 6/1979 | Chan | 339/45 |
| 4,314,735 | 2/1982 | Fullenkamp et al. | 339/45 |
| 4,508,404 | 4/1985 | Frawley | 339/45 |
| 4,778,400 | 10/1988 | Jacobs | 439/152 |
| 4,850,886 | 7/1989 | Berke | 439/152 |

FOREIGN PATENT DOCUMENTS

| | | | |
|---|---|---|---|
| 609155 | 5/1978 | U.S.S.R. . | |
| 1001253 | 2/1983 | U.S.S.R. | 439/38 |
| 1359736 | 7/1974 | United Kingdom . | |
| 2174556 | 11/1986 | United Kingdom . | |

*Primary Examiner*—Joseph H. McGlynn

*Attorney, Agent, or Firm*—Flynn, Thiel, Boutell & Tanis

[57] ABSTRACT

An electrical power cord in one embodiment comprises a plug having prongs for insertion in an electrical outlet, a tubular member disposed about the plug, the plug and said tubular member being relatively movable. A spring is disposed between the tubular member and the plug and compressed when the prongs are inserted in the outlet so as to bias the plug in a direction away from the outlet. An interlocking lever is disposed on the tubular member for interlocking the tubular member and the plug when the prongs are inserted in the outlet. A wire coil is disposed on the tubular member and is provided with an electrical current when the prongs are inserted in the outlet to move a magnetically susceptible trip means in a manner to disengage the interlocking lever and allow the spring to eject the plug from the outlet.

19 Claims, 2 Drawing Sheets

ELECTRICAL POWER CORD AND APPLIANCE USING SAME

FIELD OF THE INVENTION

The present invention relates to an electrical power supply cord and an appliance including an electrical power supply cord wherein a self-ejecting plug insertable in a conventional electrical outlet is provided on the supply cord and means is provided to remotely-control ejection of the plug from the outlet to save the user of the cord/appliance from having to return to the electrical outlet to disengage the plug therefrom.

BACKGROUND OF THE INVENTION

Portable electrical appliances, such as floor polishing machines, lawn trimming devices, vacuum cleaners and the like, include an electrical power supply cord that is plugged into a suitable electrical outlet or socket to power the appliance during operation. The user of the appliance inserts the power cord plug into the wall outlet and commences to use the appliance after actuating a power on/off switch on the appliance. Typically, the user begins the floor polishing or other operation proximate the wall outlet and continues operation at gradually increasing distances from the wall outlet until the power supply cord reaches its maximum length. Then, the user must walk back to the wall outlet, remove the power cord plug from the outlet, and proceed to the next wall outlet where the power cord plug is inserted to continue operation of the appliance. This sequence is repeated until the entire work area has been treated by the appliance (e.g., the entire length of a hall floor has been polished). Operation of the appliance in this manner is time consuming and laborious in that the user must repeat the aforementioned sequence numerous times to complete the job involved, such as polishing the floor of a lengthy hall.

It is an object of the present invention to provide an improved electrical power supply cord and an appliance including such an electrical power supply cord wherein a self-ejecting plug is provided on the supply cord and means is provided to remotely-control ejection of the plug in a manner to save the user of the cord/appliance from having to return to the electrical outlet to disengage the plug therefrom when the user reaches the maximum operating length of the power cord.

SUMMARY OF THE INVENTION

The present contemplates an electrical power supply cord comprising a plug having prongs for insertion in an electrical outlet and a tubular member disposed about the plug. The plug and tubular member are relatively movable. Spring means is disposed between the tubular member and the plug and is compressed when the prongs are inserted in the outlet so as to bias the plug in a direction away from the outlet. Means is disposed on the tubular member for interlocking the tubular member and the plug when the prongs are inserted in the outlet. A wire coil means is disposed on the tubular member and is provided with an electrical current by suitable means when the prongs are inserted in the outlet. Trip means is movable in response to energization of the wire coil means in a manner to disengage the interlocking means and allow the spring means to eject the plug from the outlet.

In one embodiment of the invention, the tubular member comprises a plastic sleeve disposed about the plug and including an open end engageable with a cover plate of the outlet when the prongs are inserted in the outlet.

In another embodiment of the invention, the tubular member includes a first shoulder and the plug includes a second shoulder axially spaced from the first shoulder. The spring means comprises a coil spring disposed between the shoulders about the plug.

In still another embodiment of the invention, the interlocking means comprises a spring biased interlocking lever disposed on the tubular member and engageable in a recess in the plug through an aperture in the tubular member to interlock the tubular member and the plug. The interlocking lever and recess include cooperating cam surfaces in engagement when the tubular member and plug are interlocked. The trip means comprises a magnetically susceptible trip member movably disposed on the plug for movement in response to coil energization. The trip member is movable in response to energization of the coil to disengage the interlocking lever and recess and allow the spring means to eject the plug from the outlet.

In a further embodiment of the invention, the means for passing an electrical current through the coil comprises an AC-to-DC electrical transformer and an electrical switch operative to provide a direct electrical current to the coil. The electrical transformer and the switch may be disposed proximate a female socket of the cord.

The present invention also contemplates an electrical power supply cord comprising a plug having prongs for insertion in an electrical outlet and a magnetically susceptible member disposed on the plug and being relatively movable to a tubular member disposed about the plug in response to energization of a wire coil means disposed on the tubular member. Means is provided for passing an electrical current through the coil means when the prongs are inserted in the outlet to effect movement of the magnetically susceptible member and thus the plug in a manner to eject the plug from the outlet.

In another embodiment of the invention, the means for passing an electrical current through the coil comprises an AC-to-DC electrical transformer and an electrical switch operative to provide a direct electrical current to the coil.

The present invention further contemplates an electrical power supply cord comprising a plug having prongs for insertion in an electrical outlet and a magnetically susceptible plunger movable between the prongs in response to energization of a wire coil means to eject the plug from the outlet.

The present invention also contemplates an electrical appliance or machine including an electrical power cord in accordance with an embodiment described hereinabove.

DETAILED DESCRIPTION OF THE INVENTION

Figure 1:
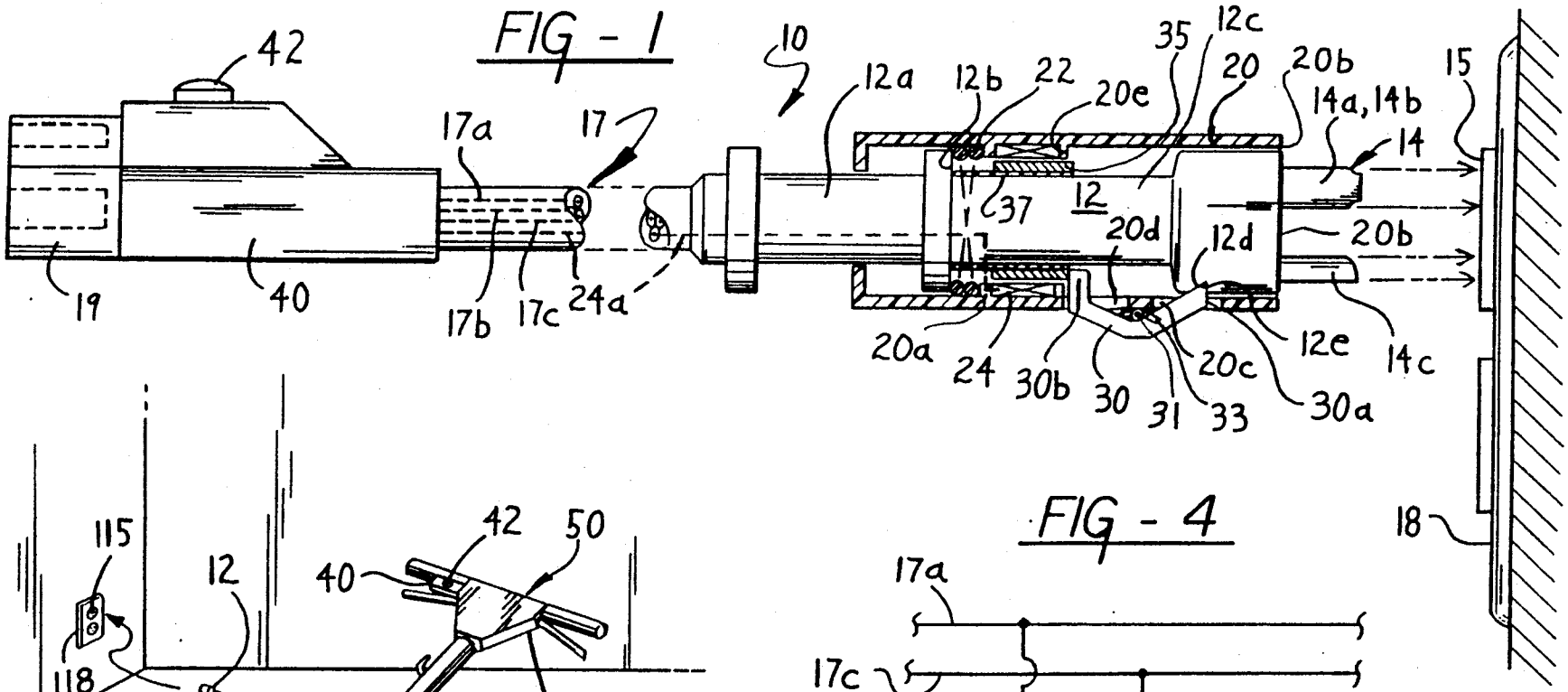
FIG. 1 is an elevational view, partially in section and partially broken in a longitudinal direction, of an electrical power cord in accordance with one embodiment of the invention before the plug is inserted in an electrical wall outlet.
Figure 2:
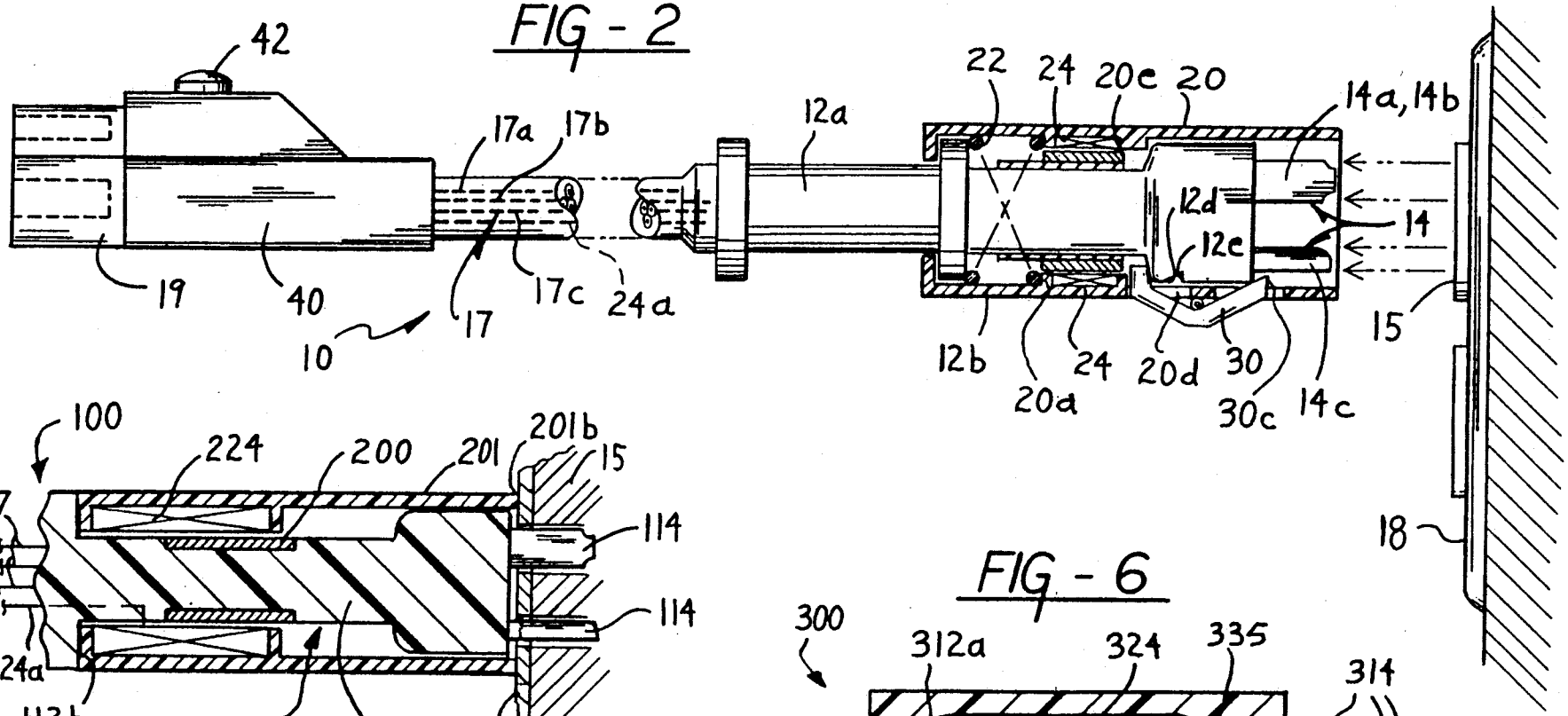
FIG. 2 is an elevational view, partially broken in a longitudinal direction, of the plug of the electrical power cord similar to FIG. 1 after the plug is ejected from the electrical wall outlet.

Referring to FIGS. 1-2, an electrical power cord 10 in accordance with one embodiment of the invention is illustrated. The electrical power cord 10 comprises a plastic, rubber or electrical insulating male plug 12 having the usual two or three metal prongs 14 disposed therein for insertion in an electrical outlet 15 surrounded by the usual cover plate 18. The prongs 14 are connected to respective wires 17 (e.g., prong 14*a* to 110 V (hot) wire 17*a*, prong 14*b* to neutral wire 17*b*, prong 14*c* to ground wire 17*c* as shown schematically) which extend in conventional manner through the cord to a female socket 19. The plug 12 includes an axially elongated outer shank 12*a* and inner shank 12*c* separated by a radially extending shoulder 12*b*.

An electrical insulating (e.g., plastic) tubular member or sleeve 20 is disposed about the plug 12 to enclose same as shown in FIG. 1 when the prongs are being inserted in the outlet 15. The tubular member 20 and the plug are relatively movable as will become apparent below. Spring means 22 in the form of a steel compression coil spring is disposed between the tubular member 20 and the plug 12. In particular, the spring 22 is located between a radially extending shoulder 20*a* of the tubular member 20 and the shoulder 12*b* of the plug 12 so that the spring is compressed when the prongs 14 are inserted in the outlet 15. The spring thereby biases the plug 12 in a direction away from the outlet 15. When the plug prongs 14 are inserted, the open end 20*b* of the tubular member 20 is engaged with the cover plate 18.

Means is disposed on the tubular member 20 for interlocking the tubular member 20 and the plug 12. The interlocking means comprises an spring biased interlocking lever 30 pivotally disposed on the tubular member 20 by pivot pin 31. A bias spring 33 is disposed about the pivot pin 31 and biases a cam end 30*a* of the lever 30 through an aperture 20*c* in the tubular member 20. The cam end 30*a* is engageable in a recess 12*d* in the plug 12 through the aperture 20*c* to interlock the tubular member and the plug. In particular, the cam end 30*a* is in engagement with cam surface 12*e* of recess 12*d* when the tubular member and plug are interlocked as shown in FIG. 1.

Typically, the tubular member 20 is slid axially prior to insertion of the plug 12 into the outlet 15 to interlock the tubular member 20 and the plug 12 in the manner shown in FIG. 1. Thus, the tubular member 20 and plug 12 are interlocked when the prongs 14 are inserted in the outlet 15.

The cam end 30*a* is disengaged from the recess 12*d* against the bias of the spring 33 by a magnetically susceptible (e.g., steel) tubular trip member 35 disposed (e.g., affixed) on a plastic trip sleeve 37 that is relatively axially movably mounted on the inner shank 12*c* of the plug 12. The trip member 35 and sleeve 37 are movable axially toward the cam end 30*a* to effect disengagement. Axial movement away from the cam end 30*a* is limited by the shoulder 12*b*. In particular, the trip member 35/sleeve 37 are caused to move axially and engage the opposite end 30*b* of the lever 30 in a manner to pivot it to remove cam end 30*a* out of recess 12*d* . The end 30*b* of the lever 30 extends through aperture 20*d* in tubular member 20. The trip member 35/sleeve 37 are caused to move by passing an electrical current through a wire coil 24 disposed on the tubular member 20 between shoulders 20*a* and 20*e*. To this end, the trip member 35 is made typically of steel or other iron-based material such that the magnetic field generated by the energized wire coil 24 will cause axial movement of the trip member 35 and sleeve 37 in a direction to disengage the interlocking means and allow the spring means 22 to eject the plug 12 from the outlet 15. The plug shank 12*c* will slide through the sleeve 37 during plug ejection; e.g., as is apparent from FIG. 2.

In particular, the wire coil means 24 is disposed on the tubular member 20 between the tubular member 20 and the plug 12 about the trip member 35. The coil 24 is provided with an electrical current when the prongs 14 are inserted in the outlet 15 to move the trip member 35 in the axial direction to disengage the cam end 30*a* from recess 12*d* and allow the spring 22 to eject the plug 12 from the outlet 15.

Figure 4:
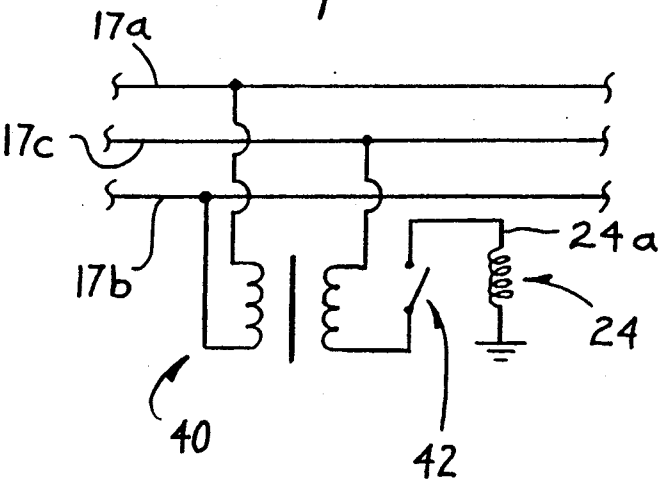
FIG. 4 is a schematic of the wiring of the switch and the transformer of the cord of FIG. 1.

The wire coil 24 is provided with DC electrical current by means comprising an AC-to-DC electrical transformer 40, an electrical switch 42 proximate the female socket 19 and supply wire 24*a* and ground wire (not shown in FIGS. 1-2) extending from the plug shank 12*c* through the shoulder 20*a* to the coil 24 with slack to accommodate movement of the plug relative to the coil. In particular, the switch 42 and transformer 40 are wired in a manner shown in FIG. 4 such that the switch controls electrical current to the coil.

In accordance with one embodiment of the invention, the female socket 19 receives the male plug of an electrical appliance or machine, such as a floor polishing machine, lawn trimmer, vacuum cleaner and the like, to provide electrical power thereto.

Figure 3:
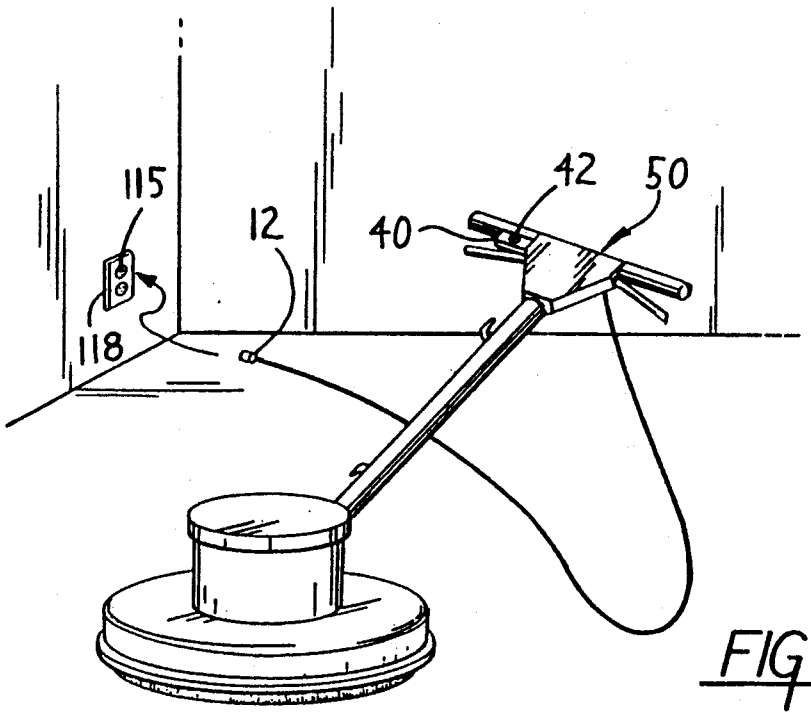
FIG. 3 is a perspective view of an electrical appliance in accordance with one embodiment of the invention including a cord of the invention.

In accordance with another embodiment of the invention, the transformer 40 and switch 42 are incorporated into the handle of the electrical appliance 50, FIG. 3, and the cord 10 extends from the handle as an integral power supply cord thereof.

Regardless of whether the cord 10 is plugged to the conventional power supply cord of the appliance or is incorporated integrally therewith as illustrated in FIG. 3, the user of the appliance initially plugs the male plug 12 into a suitable wall or other electrical outlet 15 shown in FIGS. 1 and 3. The user can then move the appliance away from the outlet 15 as the appliance is used; e.g., to polish the floor, trim a lawn etc. When the cord connected to the appliance reaches its maximum length, the user actuates switch 42 to supply power to the coil 24 to cause ejection of the plug 12 from the outlet 15 without having to return to the outlet 15 to physically remove the plug 12. The switch 42 may be actuated proximate the female socket 19 of the cord 10 or at the handle of the appliance, depending upon whether the cord 10 is used in conjunction with a conventional power cord of the appliance or whether the cord 10 is incorporated integrally with the appliance as shown in FIG. 3. Such remote actuation of the plug 12 to self-eject from the outlet 15 saves labor and time in using the appliance to perform a given job. The invention can be used to this end in relation to domestic appliances, such as electric vacuum cleaners, lawn trimmers, lawn mowers, etc., and commercial appliances, such as electrical floor buffers, building tools, etc.

Figure 5:
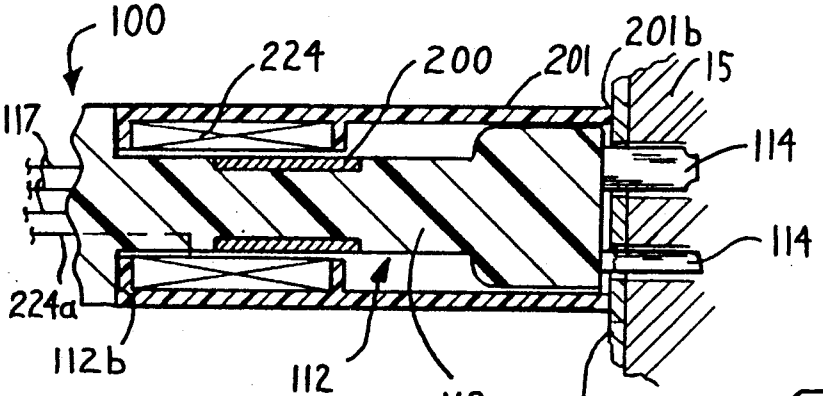
FIG. 5 is a partial sectional view of an electrical power supply cord in accordance with another embodiment of the invention with the plug inserted in an electrical wall outlet.

Referring to FIG. 5, an electrical power cord 100 in accordance with another embodiment of the invention is illustrated. The electrical power cord 100 comprises a plastic, rubber or electrical insulating male plug 112 having the usual two or three metal prongs 114 disposed therein for insertion in an electrical outlet (like outlet 15 of FIG. 1) surrounded by the usual cover plate (like cover plate 18). The prongs 114 are connected to respective wires 117 (e.g., hot wire, neutral wire, ground wire as shown schematically) which extend in conventional manner through the cord to a female socket like that shown in FIG. 1. The plug 112 includes an axially elongated shank 112*a* having a radially extending shoulder 112*b* for purposes to be explained.

A magnetically susceptible (e.g., iron-based material such as steel) tubular member or sleeve 200 is fixedly disposed (e.g., adhered) on the plug 112. The plug 112 is axially movable relative to the insulating tubular member 201 in response to generation of a magnetic field as will become apparent below. When the plug prongs 114 are inserted in the outlet, the open end 201*b* of the tubular member 201 typically is engaged to the cover plate 18. The tubular member 201 may be a suitable insulating material, such as plastic, and the like.

A wire coil 224 is located on the tubular member 201 about the sleeve 200 and is provided with DC electrical current by an AC-to-DC electrical transformer and an electrical switch proximate the female socket in the manner illustrated in FIG. 1. When the wire coil 224 is energized with electrical current in the proper direction, the resultant magnetic field will cause the plug 112 to move away from the outlet 15 to eject the plug therefrom.

As mentioned hereinabove, the female socket receives the male plug of an electrical appliance, such as a floor polishing machine, to provide electrical power thereto. Alternately, the switch and transformer are incorporated into the handle of the electrical appliance 50, FIG. 3, and the cord extends from the handle as an integral power supply cord thereof.

Regardless of whether the cord 100 is plugged to the conventional power supply cord of the appliance or is incorporated integral therewith as illustrated in FIG. 3, the user of the appliance initially plugs the male plug 112 into a suitable wall or other electrical outlet 15. The user can then move the appliance away from the outlet as the appliance is used; e.g., to polish the floor. When the cord connected to the appliance reaches its maximum length, the user actuates switch to supply power to the coil 224 via supply wire 224*a* and ground wire (not shown in FIG. 5) to eject the plug 112 from the outlet 15 without having to return to the outlet 15 to physically remove the plug 112. The wires to the coil 124 have slack between the plug and coil to allow required relative movement for ejection. The switch may be actuated proximate a female socket of the cord 100 or at the handle of the appliance, depending upon whether the cord 100 is used in conjunction with a conventional power cord of the appliance or whether the cord 100 is incorporated integral with the appliance as shown in FIG. 3. Such remote actuation of the plug 112 to self-eject saves labor and time in using the appliance to perform a given job.

Figure 6:
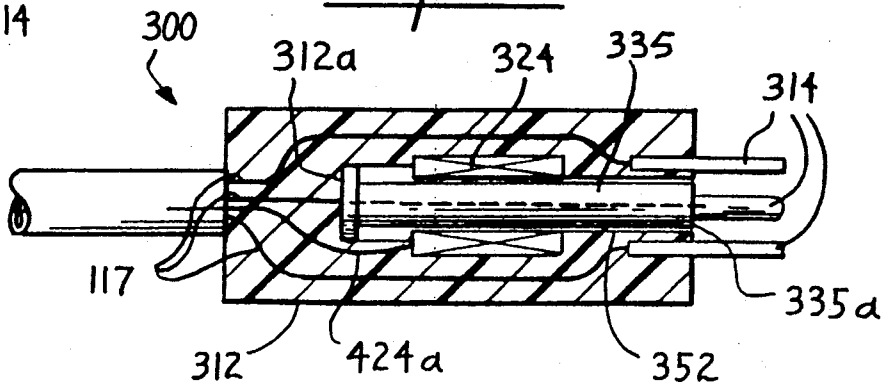
FIG. 6 is a partial sectional view of an electrical power supply cord in accordance with still another embodiment of the invention.

FIG. 6 illustrates still another embodiment of an electrical power supply cord 300 wherein the cord comprises a plastic, rubber or electrical insulating male plug 312 having the usual two or three metal prongs 314 connected to respective wires 117 (e.g., hot wire, neutral wire, ground wire shown schematically) which extend in conventional manner through the cord to a female socket like that shown in FIG. 1.

A magnetically susceptible plunger 335 is disposed in the male plug bore 352 between the prongs 314 for axial movement in response to the magnetic field established by energization of wire coil 324 via a supply wire 224*a* and ground wire (not shown in FIG. 6). When the prongs 314 are inserted in an electrical outlet, the outer end 335*a* of the plunger 335 engages the electrical outlet (e.g., designated 15 in FIG. 1) such that axial movement or bias of the plunger toward the shoulder 312*a* of the plug will provide sufficient force to eject the plug from the outlet. The wire coil 324 is energized remotely in the manner described above for the other embodiments.

Although the invention has been described in terms of specific embodiments thereof, it is to be understood that modifications and changes can be made thereto within the scope of the invention and appended claims.

I claim:

1. An electrical power cord comprising a plug having prongs for insertion in an electrical outlet, an electrical insulating tubular member disposed about the plug, said plug and said tubular member being relatively movable, spring means disposed between the tubular member and the plug and compressed while the prongs are inserted in the outlet so as to bias the plug in a direction away from the outlet, means disposed on the tubular member for releasably interlocking the tubular member and the plug when the prongs are inserted in the outlet, wire coil means disposed on the tubular member, magnetically susceptible trip means disposed between the tubular member and the plug for movement in response to energization of the wire coil means, manually operable switch means operably associated with said cord for passing an electrical current through the coil means while the prongs are inserted in the outlet to move the trip means in a manner to disengage the interlocking means and allow the spring means to eject the plug from the outlet.

2. The cord of claim 1 wherein the tubular member comprises said electrical insulating sleeve disposed about the plug and having an open end, said tubular member being interlockable in a retracted position relative to the prongs by the interlocking means so as to expose the prongs for insertion in the outlet.

3. The cord of claim 1 wherein the tubular member includes a first shoulder and the plug includes a second shoulder axially spaced from the first shoulder, and the spring means comprises a coil spring disposed between the shoulders about the plug.

4. The cord of claim 1 wherein the interlocking means comprises an spring biased interlocking lever disposed on the tubular member and engageable in a recess in the plug through an aperture in said tubular member to interlock said tubular member and the plug.

5. The cord of claim 4 wherein the interlocking lever and recess include cooperating cam surfaces in engagement when the tubular member and plug are interlocked.

6. The cord of claim 5 wherein the trip means comprises a magnetically susceptible trip member about the plug movable to disengage the interlocking lever when the coil is energized, thereby disengaging the interlocking means and allowing the spring means to eject the plug from the outlet.

7. The cord of claim 1 wherein the means for passing an electrical current through the coil comprises an AC-to-DC electrical transformer and an electrical switch operative to provide a direct electrical current to the coil.

8. The cord of claim 7 wherein the electrical transformer and the switch are disposed proximate a female socket of the cord.

9. An electrical appliance or machine including an electrical power cord comprising a plug having prongs for insertion in an electrical outlet, an electrical insulating tubular member disposed about the plug, said plug and said tubular member being relatively movable, spring means disposed between the tubular member and the plug and compressed while the prongs are inserted in the outlet so as to bias the plug in a direction away from the outlet, means disposed on the tubular member for releasably interlocking the tubular member and the plug when the prongs are inserted in the outlet, wire coil means disposed on the tubular member, magnetically susceptible trip means disposed between the tubular member and the plug for movement in response to energization of the wire coil means, manually operable switch means on the appliance or machine and operably associated with said cord for passing an electrical current through the coil means while the prongs are inserted in the outlet to move the trip means in a manner to disengage the interlocking means and allow the spring means to eject the plug from the outlet.

10. The electrical appliance or machine of claim 9 wherein the means for passing an electrical current through the coil comprises an AC-to-DC electrical transformer and an electrical switch disposed on the appliance or machine and operative to provide a direct electrical current to the coil.

11. The electrical appliance or machine of claim 10 wherein the electrical transformer and switch are disposed on a handle of the appliance or machine.

12. An electrical power cord comprising a plug having prongs for insertion in an electrical outlet, a magnetically susceptible member fixedly mounted on the plug, an electrical insulating tubular member disposed about the plug and having wire coil means disposed thereon, said tubular member and plug being relatively movable, manually operable switch means operably associated with said cord for passing an electrical current through the coil means while the prongs are inserted in the outlet to effect movement of the magnetically susceptible member relative to said tubular member in a manner to eject the plug from the outlet.

13. The cord of claim 12 wherein the magnetically susceptible member comprises a magnetically susceptible sleeve fixedly disposed on the plug.

14. The cord of claim 13 wherein the sleeve comprises an iron-based sleeve.

15. The cord of claim 12 wherein the means for passing an electrical current through the coil comprises an AC-to-DC electrical transformer and an electrical switch operative to provide a direct electrical current to the coil.

16. The cord of claim 15 wherein the electrical transformer and the switch are disposed proximate a female socket of the cord.

17. An electrical appliance or machine including an electrical power cord comprising a plug having prongs for insertion in an electrical outlet, a magnetically susceptible member fixedly mounted on the plug, an electrical insulating tubular member disposed about the plug and having wire coil means disposed thereon, said tubular member and plug being relatively movable, manually operable switch means on the appliance or machine and operably associated with said cord for passing an electrical current through the coil means while the prongs are inserted in the outlet to effect movement of the magnetically susceptible member relative to said tubular member in a manner to eject the plug from the outlet.

18. The electrical appliance or machine of claim 17 wherein the means for passing an electrical current through the coil comprises an AC-to-DC electrical transformer and an electrical switch disposed on the appliance or machine and operative to provide a direct electrical current to the coil.

19. The electrical appliance or machine of claim 18 wherein the electrical transformer and switch are disposed on a handle of the appliance or machine.

* * * * *